US011545127B2

(12) United States Patent
Vinamata et al.

(10) Patent No.: US 11,545,127 B2
(45) Date of Patent: Jan. 3, 2023

(54) METHOD AND SYSTEM FOR REDUCING NOISE IN A VEHICLE

(71) Applicant: JAGUAR LAND ROVER LIMITED, Coventry (GB)

(72) Inventors: Xavier Vinamata, Warwickshire (GB); Mark Willis, Warwickshire (GB); Sean True, Warwickshire (GB)

(73) Assignee: Jaguar Land Rover Limited, Coventry (GB)

( * ) Notice: Subject to any disclaimer, the term of this patent is extended or adjusted under 35 U.S.C. 154(b) by 0 days.

(21) Appl. No.: 15/988,587

(22) Filed: May 24, 2018

(65) Prior Publication Data

US 2019/0013004 A1 Jan. 10, 2019

(30) Foreign Application Priority Data

Jul. 4, 2017 (GB) ..... 1710695

(51) Int. Cl.
*G10K 11/178* (2006.01)

(52) U.S. Cl.
CPC .... *G10K 11/17879* (2018.01); *G10K 11/1783* (2018.01); *G10K 11/17823* (2018.01); *G10K 11/17825* (2018.01); *G10K 11/17883* (2018.01); *G10K 2210/1282* (2013.01); *G10K 2210/3011* (2013.01); *G10K 2210/3056* (2013.01)

(58) Field of Classification Search
CPC ..... G10K 11/17879; G10K 11/17823; G10K 11/17825; G10K 2210/1282; G10K 2210/3011; G10K 2210/3056; G10K 11/1783; G10K 11/17883
USPC .... 381/74.1, 71.1, 71.2, 71.7, 86, 94.1, 122, 381/71.4
See application file for complete search history.

(56) References Cited

U.S. PATENT DOCUMENTS 5,426,703 A * 6/1995 Hamabe ..... G10K 11/178 381/71.12
5,809,152 A * 9/1998 Nakamura ..... G10K 11/178 381/71.1
8,891,781 B2 * 11/2014 Ohta ..... G10K 11/17883 381/71.4
2008/0159553 A1 * 7/2008 Copley ..... G10K 11/178 381/71.1
2010/0080399 A1 * 4/2010 Pfau ..... B60N 2/56 381/71.4

* cited by examiner

*Primary Examiner* — Vivian C Chin
*Assistant Examiner* — Con P Tran
(74) *Attorney, Agent, or Firm* — McCoy Russell LLP

(57) ABSTRACT

Embodiments include a method and noise cancelling system for cancelling noise in a vehicle by operating at least one noise cancelling means in a first mode of operation to output a noise cancelling signal; receiving at least one input indicative of a state of the vehicle; determining if noise cancelling error conditions are present based on the at least one received input indicative of a state of the vehicle; and operating at least one noise cancelling means in a second mode of operation if noise cancelling error conditions are determined as present.

17 Claims, 3 Drawing Sheets

METHOD AND SYSTEM FOR REDUCING NOISE IN A VEHICLE

CROSS REFERENCE TO RELATED APPLICATION

This application claims priority to and the benefit of Great Britain Patent Application No. 1710695.6 filed Jul. 4, 2017, which is incorporated herein by reference in its entirety.

TECHNICAL FIELD

The present disclosure relates to a method and a system for reducing noise in a vehicle and particularly, but not exclusively, to a method and controller for reducing noise in a vehicle. Aspects of the invention relate to a method for reducing noise in a vehicle, to a controller for noise cancelling in vehicles, to a noise cancelling system, to computer software, and to a vehicle comprising such.

BACKGROUND

Noise, especially within a vehicle cabin, may be distracting or tiring for the occupants of the vehicle. Passive measures are commonly used to reduce noise within vehicle cabins. These measures comprise installing materials to dampen noise in the vehicle. However, such measures are bulky, add weight and have limited efficacy compared to active noise cancellation. Active noise cancellation involves the generation of a sound wave that cancels the sound wave associated with the undesirable cabin noise. The cancelling of the undesirable sound wave makes the vehicle cabin quieter for occupants of the vehicle.

It is an aim of at least certain embodiments of the present invention to at least mitigate one or more of the disadvantages of the prior art.

SUMMARY

Aspects and embodiments of the invention provide a method for reducing noise in a vehicle, a controller for noise cancelling in a vehicle, a noise cancelling system and a vehicle comprising such, as claimed in the appended claims.

According to an aspect of the invention, there is provided a method of reducing noise in a vehicle, the method comprising: operating a noise cancelling apparatus in a first mode of operation to output a noise cancelling signal; receiving an input indicative of a state of the vehicle; determining if a noise cancelling error condition is present in dependence on the received input; and operating the noise cancelling apparatus in a second mode of operation in dependence on the determination.

The noise cancelling apparatus may comprise a controller having a processor or a signal processor.

According to an aspect of the invention, there is provided a method of reducing noise in a vehicle. The method comprises operating a noise cancelling means in a first mode of operation to output a noise cancelling signal. The method also comprises receiving an input that is indicative of a state of the vehicle and determining if a noise cancelling error condition is present in dependence on the received input. The method also comprises operating in a second mode of operation in dependence on the determination.

In embodiments, operating the noise cancelling means may comprise: receiving an audio signal; determining a noise cancelling signal in dependence on the received audio signal; and outputting the noise cancelling signal in dependence on the mode of operation.

In embodiments, the method may comprise operating in the second mode when the noise cancelling condition is determined to be present.

The noise cancelling error condition may be considered to be a condition in which operation of a noise cancelling system may lead to an increase of the noise experienced by the occupant rather than reducing it. This may occur, for example, when a noise cancelling system receives high volume noise. This may include, for example, buffeting from an open window.

By monitoring vehicle state, the mode of operation of noise cancelling can be changed to avoid the noise cancelling system increasing cabin noise rather than cancelling it when a noise cancelling error condition occurs. By monitoring vehicle state the mode of operation can be changed before a noise cancelling system operates in a noise cancelling error condition. Thus the situation where a noise cancelling system contributes noise to a vehicle cabin rather than cancelling it can be avoided before it occurs.

A vehicle status may comprise any parameter relevant to current operating conditions of a vehicle. This may include, for example, position of a body aperture closure member (position of a window or sunroof), vehicle speed, etc.

In embodiments, the operating parameters of the second mode of operation may be determined in dependence on the received input indicative of the state of vehicle.

In embodiments, at least one parameter of the noise cancelling signal is modified in dependence on the mode of operation.

In embodiments, the second mode of operation may comprise outputting a noise cancelling signal with reduced volume, or not outputting the noise cancelling signal.

In embodiments, changing from operating in a first mode of operation to operating in a second mode of operation may comprise transitioning from the first mode of operation to the second mode of operation. The transitioning between modes may comprise transitioning over a period of time.

In embodiments, the noise cancelling signal may be derived by applying a transfer function to the received audio signal. In embodiments, operating in the second mode of operation may comprise modifying the transfer function.

In embodiments, the method may comprise changing the mode of operation to the first mode if a noise cancelling error condition is determined as not present whilst operating in the second mode.

In embodiments, the received input may be indicative of the position of at least one aperture closure member of the vehicle, and/or may be indicative of a speed of the vehicle, and/or may be indicative of cabin noise. Without limitation, the aperture closure member of the vehicle body may comprise a vehicle window or a sunroof.

In embodiments, the noise cancelling error condition may comprise a condition of the vehicle where outputting the noise cancelling signal would increase the noise in a cabin of the vehicle in the first mode of operation.

In embodiments, at least one parameter of the noise cancelling signal may be modified in dependence on the mode of operation.

The second mode of operation may be a different mode of operation to the first mode of operation. For example, an operating parameter associated with operation of the noise cancelling system may be different between the first and second modes. Non-limiting examples may include the volume of an outputted noise cancelling signal being lower in one mode, or the noise cancelling signal being determined using a different process in one of the modes.

In embodiments, if operating in the second mode, the input indicative of a state of the vehicle may continue to be received to determine if noise cancelling error conditions have stopped. If noise cancelling error conditions have stopped the noise cancelling means may resume operating in the first mode of operation.

In embodiments, the operating parameters of the second mode of operation may be determined in dependence on the received input indicative of the state of vehicle. This may allow the second mode of operation to be adapted to address different noise cancelling error conditions.

In embodiments, the second mode of operation may comprise reducing the volume of the noise cancelling signal outputted in the first mode of operation, or may comprise not outputting the noise cancelling signal outputted in the first mode of operation. This provides a straight-forward way of preventing a noise cancelling system from increasing noise in a vehicle cabin in the presence of noise cancelling error conditions.

In embodiments, changing from a first mode of operation to a second mode of operation may comprise transitioning from the first mode of operation to the second mode of operation. This may further reduce an occupant being alerted to a change of mode of operation.

Transitioning from the first mode of operation to the second mode of operation may comprise changing the operating parameters in the first mode of operation to the operating parameters of the second mode of operation over a time period. The time period may, for example, be at least 0.1 seconds, 0.5 seconds, 1 second, 5 seconds or 10 seconds. The time period may, for example, be no longer than 0.1 seconds, 0.5 seconds, 1 second, 5 seconds or 10 seconds. In a non-limiting example, if operating in the first mode comprises outputting a noise cancelling signal at a first volume level, and operating in the second mode comprises outputting a noise cancelling signal at a second volume level; then transitioning may comprise moving through intermediate volume levels from the first volume level to the second.

In embodiments, a noise cancelling signal may be determined by applying one or more transfer functions to the received audio signal. In embodiments, operating in a second mode of operation may comprise modifying one or more transfer functions of the first mode of operation. A transfer function may comprise a function with predetermined values used to convert an audio signal to one or more noise cancelling signals. A transfer function may be modified in dependence on the received input indicative of the state of the vehicle.

In embodiments, the received at least one input may be indicative of the position of at least one aperture closure member of the vehicle. As used herein, the term aperture closure member may refer to any member of the vehicle that may be opened to present an aperture between the vehicle interior and exterior, non-limiting examples include a window, door, sunroof, roof and boot/tailgate.

In embodiments, the received at least one input may be indicative of vehicle speed and/or engine speed. In embodiments, the received at least one input may be indicative of the volume of noise in the cabin of the vehicle. In embodiments, the received at least one input may be indicative of any of the following: external temperature, internal temperature, door, tailgate or sunroof position, seat position, suspension settings or tyre pressure.

According to an aspect of the invention, there is provided a controller for a vehicle noise cancelling system, the controller comprising: an electrical input receive an input from a vehicle condition sensor; and a processor to: operate in a first mode of operation to output a noise cancelling signal; determine if a noise cancelling error condition is present in dependence on the input received from the vehicle condition sensor; and operate in a second mode of operation in dependence on the determination.

According to an aspect of the invention, there is provided a controller comprising input means configured to receive an input from a vehicle condition sensing means. The controller also comprises processing means configured to operate in a first mode of operation to output a noise cancelling signal; and to determine if a noise cancelling error condition is present in dependence on the input from the vehicle condition sensing means. The processing means is also configured to operate in a second mode of operation in dependence on the determination.

In embodiments, the controller comprises output means to output the noise cancelling signal in dependence on the mode of operation. The output means may comprise an electrical output.

In embodiments, the controller may be configured to change mode of operation from a first mode to a second mode by modifying at least one parameter of the noise cancelling signal.

In embodiments, the controller may be configured to change the mode of operation by transitioning from the first mode to the second mode; and/or from the second mode to the first mode.

In embodiments, the controller may be configured to operate in the second mode by modifying the noise cancelling signal of the first mode or not outputting the noise cancelling signal.

In embodiments, the controller may be configured to derive the noise cancelling signal by applying a transfer function to the received audio signal.

In embodiments, the controller may be configured to modify the transfer function in dependence on the mode of operation.

In embodiments, the controller may be configured to change to the first mode if a noise cancelling error condition is determined as not present whilst operating in the second mode.

According to an aspect of the invention, there is provided a noise cancelling system for a vehicle. The noise cancelling system comprises at least one vehicle condition sensing means to sense at least one vehicle condition and at least one controller. The controller may comprise a controller according to an aspect of the invention as described herein.

In embodiments, the system may comprise a sound sensing means for detecting sound and outputting an audio signal. The sound sensing means may comprise an acoustic sensor, e.g. a microphone, an accelerometer or a vibration sensor.

In embodiments, the system may comprise an audio output means to output the noise cancelling signal. The audio output means may comprise an electrical output, for example from an amplifier.

In embodiments, the controller may be configured to receive an audio signal and determine a noise cancelling signal in dependence on the audio signal.

In embodiments, the controller may be configured to change mode of operation from a first mode to a second mode by modifying at least one parameter of the noise cancelling signal.

In embodiments, the vehicle condition sensing means may comprise a sensor to determine aperture closure member position. In embodiments, the vehicle condition sensing means may comprise a sensor to determine a speed of the vehicle. In embodiments, the vehicle condition sensing means may comprise a sensor to determine noise in a cabin of the vehicle.

At least in certain embodiments of the controller or the noise cancelling system described above, the noise cancelling error condition may comprise a condition in the vehicle where outputting the noise cancelling signal would increase noise in the cabin if operating in the first mode.

In embodiments, the controller may be configured to perform any of the method steps described herein.

According to another aspect of the invention, there is provided computer software which, when executed may perform any of the method steps according to an earlier aspect described herein.

According to a further aspect of the invention, there is provided a vehicle comprising a controller, computer software or a noise cancelling system as described herein.

In a yet further aspect of the invention, there is provided a vehicle configured to perform any of the method steps described herein.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention will now be described by way of example only, with reference to the accompanying figures, in which.

DETAILED DESCRIPTION OF THE EMBODIMENTS

Noise may be an issue within vehicles as a noisy environment is detrimental to one or more occupants of the vehicle, such as to enjoyment and comfort of the occupants. Furthermore, a characteristic of a premium vehicle is that an environment within the vehicle is relatively quiet. Active noise cancelling may be used to reduce the noise experienced by one or more occupants within the vehicle.

Figure 1:
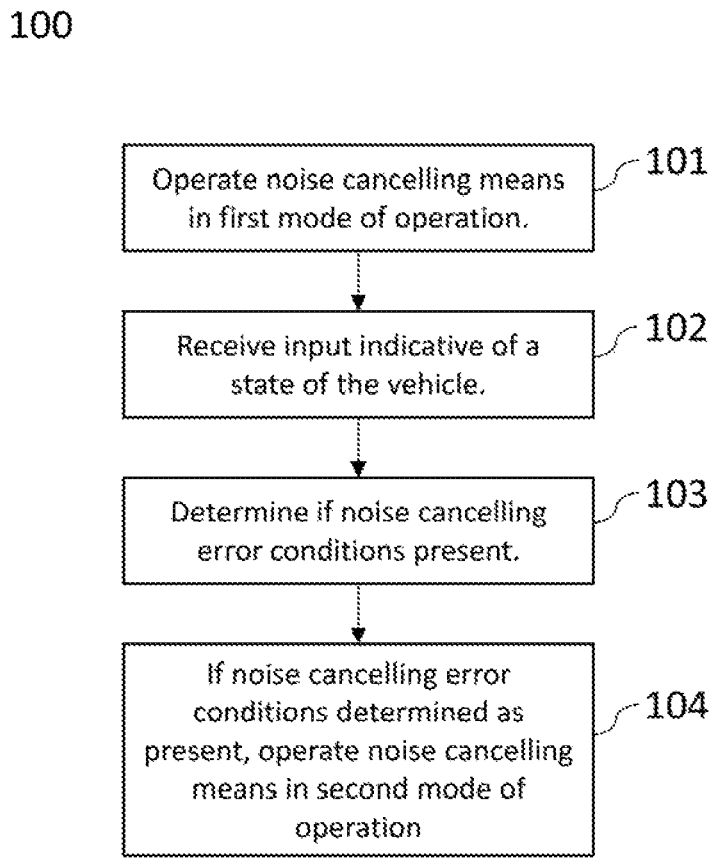
FIG. 1 illustrates an embodiment of a method in accordance with the present invention.

Active noise cancelling may be used to reduce noise generally or to selectively reduce noise arising from one or more predetermined sources. The one or more predetermined sources may include, amongst others, tyre horn associated with a wheel of the vehicle, wind noise, engine noise, road noise and external noise not generated by the vehicle Referring to FIG. 1, a method 100 for reducing noise in a vehicle is shown. The method comprises the step of operating 101 at least one noise cancelling means in a first mode of operation to output a noise cancelling signal. The method also comprises receiving at least one input indicative of a state of the vehicle 102. The method also comprises the step of determining if noise cancelling error conditions are present based on the at least one received input indicative of a state of the vehicle 103. If the noise cancelling error conditions are determined as present, the at least one noise cancelling means is then operated in a second mode of operation 104.

Operating the noise cancelling means may comprise the steps of receiving an audio signal; determining a noise cancelling signal in dependence on the received audio signal; and outputting the noise cancelling signal.

Noise cancelling error conditions may be considered to be any condition in which the noise cancelling means will output a noise cancelling signal that increases the noise experienced by an occupant rather than cancelling it. This may occur, for example, where unexpected noises or noises of high volume occur.

Determining if noise cancelling error conditions are present may comprise, for example, comparing an input received from the vehicle condition sensing means to one or more predetermined values. Predetermined values may be determined experimentally, for example, by operating a vehicle in a controlled environment and varying the status of the vehicle until noise cancelling error conditions occur. At that point, the value of the received input from the vehicle condition sensing means may be used as a predetermined threshold.

Operating a noise cancelling means in a second mode of operation may comprise changing from a first mode of operation to a second mode of operation. Changing the mode of operation may comprise changing a parameter of operation in the first mode to operate in the second mode. In a non-limiting example, the second mode of operation may comprise outputting the same noise cancelling signal as in the first mode of operation, but with a reduced volume. Thus, the second mode of operation may comprise operating with reduced volume of the outputted noise cancelling signal, and changing from the first mode of operation to the second mode of operation may comprise reducing the volume of the outputted noise cancelling signal. In non-limiting examples, changing from the first mode of operation to the second mode of operation may comprise a gradual reduction of volume of the outputted noise cancelling signal. Alternative examples of operating in the second mode of operation may include using an alternative function for determining a noise cancelling signal or changing the parameters of the function for determining a noise cancelling signal.

Operating a noise cancelling signal may comprise determining and outputting at least one noise cancelling signal. The noise cancelling signal may be determined in dependence on one or more received audio signals. In embodiments, the noise cancelling signal may be determined by applying one or more transfer functions to the received audio signal. The transfer function being a predetermined function which converts the received audio signal to a noise cancelling signal. The one or more transfer functions may be selected from an array of predetermined transfer functions or the parameters of the selected transfer function may be changed in dependence on the received input indicative of the state of the vehicle.

A determined noise cancelling signal may be outputted using an audio output means. This may comprise one or more acoustic output devices or audio emitters, a non-limiting example of which may include speakers. Outputting of the noise cancelling signal may be directed to one or more occupants of the vehicle, so that the one or more occupants may experience a reduction of noise in the vehicle. Outputting the noise cancelling signal may comprise directing output from the audio output means to one or more occupants of the vehicle, or to one or more noise cancelling zones within the vehicle cabin.

Receiving an input indicative of state of the vehicle may comprise receiving an input from one or more vehicle condition sensing means. Vehicle condition sensing means may comprise any sensor for monitoring a status of the vehicle relevant to noise cancelling conditions. Receiving an input may comprise receiving an input related to any of vehicle cabin noise, wind speed, window position, and/or vehicle speed.

Figure 2:
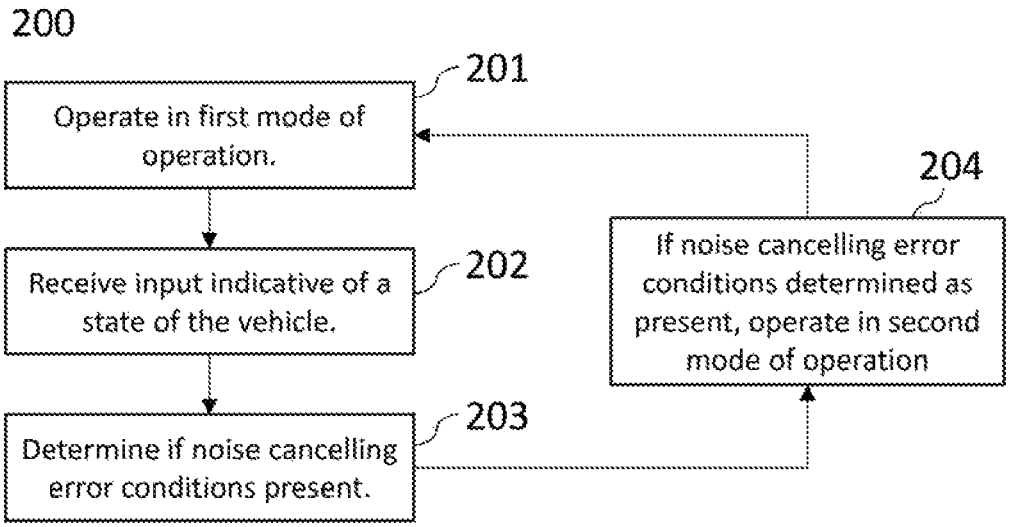
FIG. 2 illustrates an embodiment of a method in accordance with the present invention.

Referring to FIG. 2, an embodiment method 200 is shown. The method comprises operating in a first mode 201, receiving an input indicative of a state of a vehicle 202 and determining if noise cancelling error conditions are present 203 as described herein.

The method 200 also comprises step 204, where the mode of operation is changed to the second mode if noise cancelling error conditions are determined as present in step 203. The method then continues to step 201. This time, in step 201 the noise cancelling means is operating in the second mode of operation instead of the first. In step 202 an input indicative of a state of a vehicle 202 is received. Step 203 determines if noise cancelling error conditions are no longer present. If noise cancelling error conditions are no longer present, step 204 comprises operating in the first mode of operation and the method repeats starting at step 201 as initially described.

Figure 3:
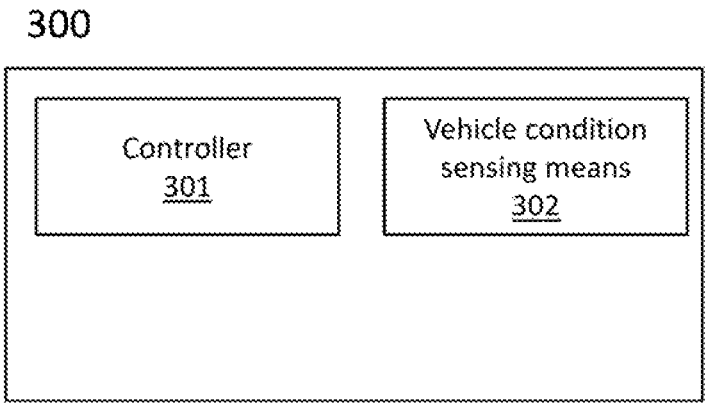
FIG. 3 shows a schematic of an embodiment of a system according to the present invention.

Referring to FIG. 3, a controller 301 is shown, the controller 301 is shown comprised as part of a noise cancelling system for a vehicle 300. The system 300 additionally comprises a vehicle condition sensing means 302 as well as the controller 301.

The vehicle condition sensing means 302 senses at least one vehicle condition. The at least one controller 301 is configured to operate in a first mode of operation to output a noise cancelling signal. The at least one controller 301 is also configured to receive an input from the vehicle condition sensing means 302 and to determine if noise cancelling error conditions are present in dependence on the input from the vehicle condition sensing means 302. The controller 301 is also configured to operate in a second mode of operation if noise cancelling error conditions are determined as present.

The vehicle condition sensing means 302 may comprise any vehicle condition sensing means 302 described herein. The vehicle condition sensing means 302 may be operable to sense a vehicle condition in accordance with any method described herein. The controller 301 may comprise any controller described herein. The controller 301 may be operable to perform any of method step described herein, or any control function of a noise cancelling system described herein.

The controller 301 may comprise processing means. The processing means may comprise a processor or other electrical circuitry operable to provide a control function to the various components in the systems defined herein including the audio output means, sound sensing means and vehicle condition sensing means. Electrical circuitry may be distributed, including on board a vehicle. The electrical circuitry may also be distributed on another component in communication with the vehicle, which may include a networked-based, including as a remote server, or cloud-based computer or portable electronic device, which may include a mobile phone. Electrical circuitry may comprise electrical components known to the skilled person, including active or passive components, e.g. combinations of transistors, transformers, resistors, capacitors or the like. The electrical circuitry may be partially embodied on a processor, including as an ASIC, microcontroller, FPGA, microprocessor, state machine or the like. The processor can include a computer program stored on a memory and/or programmable logic, for execution of a process. The memory can be a computer-readable storage medium. Executable processes of the controller may include any method steps described herein. The controller may comprise input means to receive inputs and output means to output signals.

The system 300 may additionally comprise any audio output means as described herein.

Figure 4:
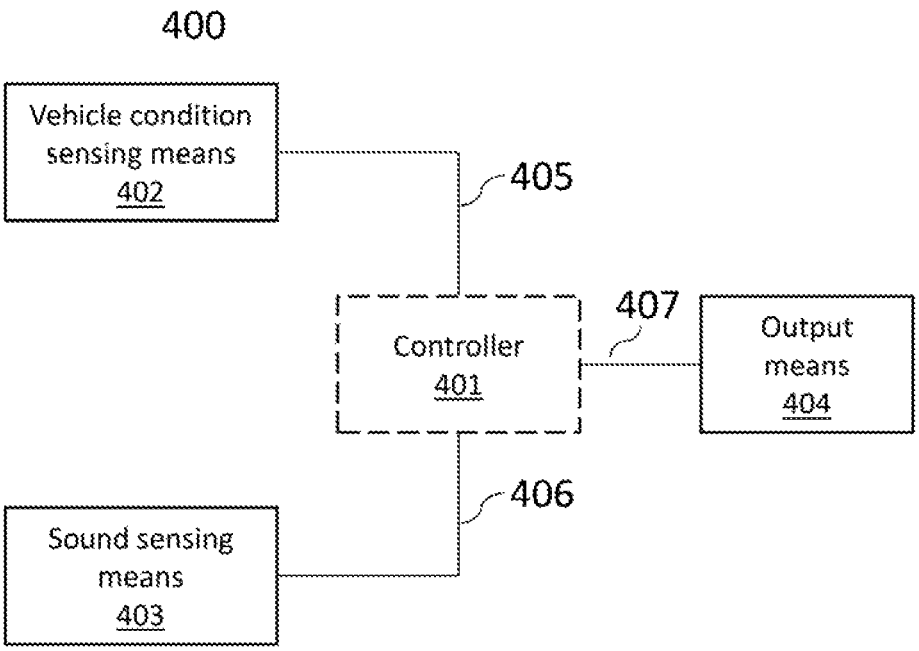
FIG. 4 shows a schematic of an embodiment of a system according to the present invention.

Referring to FIG. 4, an embodiment noise cancelling system 400 is shown. The noise cancelling system comprises at least one vehicle condition sensing means 402 to sense at least one vehicle condition; at least one sound sensing means 403 for detecting sound and outputting an audio signal; and an audio output means 404 to output the noise cancelling signal. The system 400 also comprises at least one controller to operate in a first mode of operation to output a noise cancelling signal; to receive input from the vehicle condition sensing means; to determine if noise cancelling error conditions are present in dependence on the input from the vehicle condition sensing means; and to operate in a second mode of operation if noise cancelling error conditions are determined as present.

The sound sensing means 403 is operable to detect sound and output an audio signal based thereon. The sound sensing means 403 may comprise one or more sensors, such as an acoustic sensor, e.g. a microphone, and/or may comprise one or more accelerometers, vibration sensors, vehicle status sensors, or any other sensor that can detect a phenomena or condition that may be used in determining a noise cancelling signal.

The audio output means 404 may comprise means for outputting sounds to one or more occupants of the vehicle. This may comprise one or more acoustic output devices, a non-limiting example of which includes speakers. Audio output means 404 may be arranged to output a noise cancelling signal into a noise cancelling zone. A noise cancelling zone may be considered to be a volume in the vehicle within which the system 400 is intended to cancel noise. Audio output means may be arranged so that a noise cancelling zone envelopes an occupant's ears.

The sound sensing means 403, output means 404, controller 401 and vehicle condition sensing means 402 may be any described herein and may perform any relevant method steps as described herein.

Figure 5:
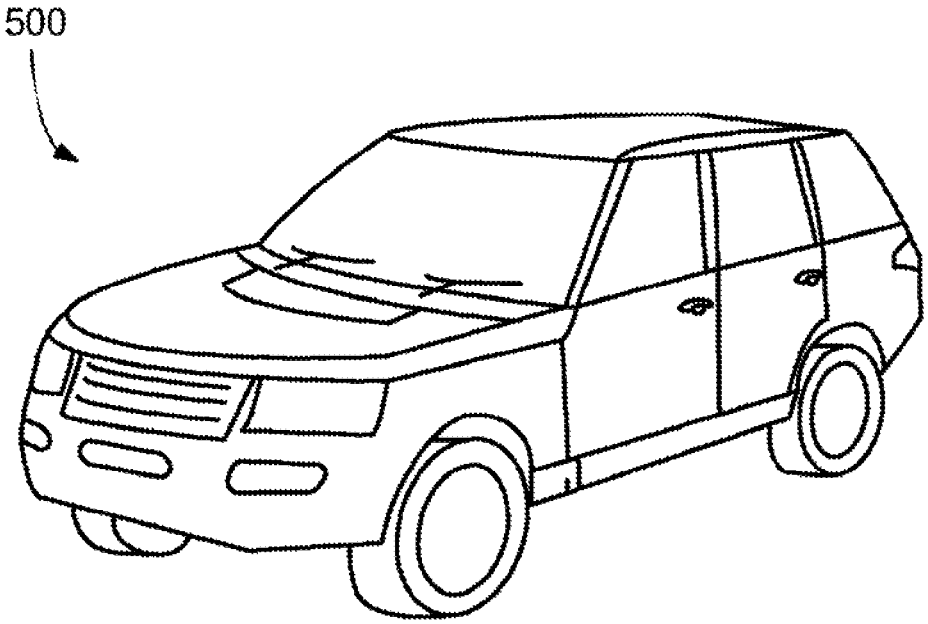
FIG. 5 shows an embodiment of a vehicle according to the present invention.

Referring to FIG. 5, a vehicle 500 is shown. The vehicle 500 may comprise apparatus to execute a method as described herein, or may comprise a controller or system as described herein.

The vehicle 500 may be powered by one or more of a combustion engine, such as petrol, diesel or gas engine, or one or more electric motors which may be driven by an energy storage means such as a battery and/or an alternative power source such as hydrogen.

In embodiments, changing the mode of operation from a first mode of operation to a second mode of operation may be performed by changing at least one property of the noise cancelling signal of the first mode of operation. For example, the property may be the volume of the outputted noise cancelling signal, or the composition of the noise cancelling signal itself. The parameter or the extent of change the parameter undergoes may be determined by the controller in dependence on the input indicative of a status of the vehicle. For example, if vehicle speed is increasing and a window is open, the amount the volume of the noise cancelling signal is reduced by may be increased.

In embodiments, the mode of operation may be changed with a gradual transition from the first mode of operation to the second mode of operation, and/or from the second mode of operation to the first mode of operation. This may comprise a gradual change of one or more of the parameters that comprise the change between modes of operation.

In embodiments, the vehicle condition sensing means may comprise a sensor to determine the position of any one of a window, door, sunroof or tailgate. For example, if any of the aforementioned are open, noise cancelling error conditions may arise.

In embodiments, the vehicle condition sensing means may comprise a sensor to determine the seat position of one or more users of the vehicle. If a user moves position, they may no longer be positioned within a noise cancelling zone, thus they may not experience noise cancelling, but instead receive a net contribution of noise from a noise cancelling system i.e. the user may experience noise cancelling error conditions by changing seat position. Thus, in an embodiment, the second mode of operation may comprise changing how the noise cancelling signal is determined or outputted to compensate. In some embodiments this may comprise changing a transfer function, and may be a speaker transfer function described herein.

In embodiments, the vehicle condition sensing means may comprise any of an external temperature sensor, engine speed, vehicle speed, suspension setting sensor, tyre temperature sensor, or tyre pressure sensor. These sensors may detect parameters relating to road and/or wind noise and thus may be used to determine the presence of noise cancelling error conditions. For example, if a vehicle exceeds a certain speed, error conditions may arise due to wind noise, noise of the tyres on the road and noise from the engine. Similarly if tyre pressure changes road noise may increase, leading to error conditions.

In embodiments, the vehicle condition sensing means may comprise a sensor to determine terrain response setting. A terrain response setting may be selected by a user when operating the vehicle off-road. When driving off-road it may be desirable for a user to temporarily suspend noise cancellation so that external sounds can be heard. The second mode of operation may comprise not outputting a noise cancelling signal, attenuating the noise cancelling signal or switching off the noise cancelling system altogether, for example. However, other second modes of operation described herein are also anticipated.

In embodiments, the vehicle condition sensing means may comprise a sensor to determine internal temperature. The speed of sound may change depending on air temperature, thus the second mode of operation may comprise changing the determination of the noise cancelling signal in order to adjust for any change of temperature.

In embodiments, the controller 301, 401 may comprise a data store. The data may store one or more parameters associated with at least one of a reference transfer function (RTF) and a speaker transfer function (STF).

The RTF transfer function may contain processing instructions to convert the signal from the sound sensing means into a noise cancelling signal. The RTF may contain processing instructions specific to one or more associated noise cancellation zones. As noted above, a respective RTF may be provided for each sensing means comprised within a system. The RTF may comprise a function comprising a plurality of coefficients. The RTF represents how noise within the vehicle 500 is caused by acoustic signals at the sound sensing means. For example, the RTF may place emphasis on acoustic signals in one or more frequency ranges resulting in noise within the noise cancellation zone.

The STF may represent a transfer function from the one or more audio output means. The STF may represent a transfer function from an audio output means i.e. the speaker to a particular noise cancellation zone in the vehicle cabin. For example, one STF may be provided for each cancellation zone in a vehicle cabin. The STF may comprise a plurality of coefficients. For example, the STF may place emphasis on acoustic signals in one or more frequency ranges resulting in noise within the noise cancellation zone. In embodiments, STF transfer functions may be changed to change from operating in a first mode to operating in the second mode. In embodiments, STFs corresponding to different noise cancellation zones may be changed as part of changing mode of operation.

The one or more parameters associated with each sensing means in a system may configure one or both of the at least one RTF or STF. In one embodiment a plurality of RTFs and/or STFs are stored within a data store of the controller. In some embodiments, one RTF and STF may receive inputs associated with a plurality of sensing means 201, 301 having one or more respective parameters.

In embodiments, input from the vehicle condition sensing means may exclude the audio input used for determining noise cancelling signals or any feedback signals used in determining a noise cancelling signal.

In embodiments, the vehicle sensing means may comprise a sensor to determine window position. In embodiments, the vehicle sensing means may comprises a sensor to determine vehicle speed. In embodiments, the vehicle sensing means may not comprise a sensor to determine cabin noise.

In embodiments, the second mode of operation may additionally comprise changing a window position. The second mode of operation may comprise any of the changes of operation described herein. In embodiments, the vehicle sensing means may comprise any combination of vehicle sensing means described herein.

It will be appreciated that embodiments of the present invention can be realised in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of machine-readable storage that are suitable for storing a program or programs that, when executed, implement embodiments of the present invention. Accordingly, embodiments provide a program comprising code for implementing a system or method as claimed in any preceding claim and a machine readable storage storing such a program. Still further, embodiments of the present invention may be conveyed electronically via any medium such as a communication signal carried over a wired or wireless connection and embodiments suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims.

The invention claimed is:

1. A method of reducing noise in a vehicle, the method comprising:

operating a noise cancelling means in a first mode of operation to output a noise cancelling signal to multiple noise cancelling zones within the vehicle;

receiving an input indicative of a state of the vehicle, wherein the received input indicates a position of at least one aperture closure member of the vehicle;

determining if a noise cancelling error condition is present based on the received input that indicates the position of the at least one aperture closure member of the vehicle; and operating the noise cancelling means in a second mode of operation based on the determination that the noise cancelling error condition is present based on the received input that indicates the position of the at least one aperture closure member of the vehicle;

wherein the noise cancelling signal is derived by applying transfer functions corresponding to different noise cancelling zones to a received audio signal, one or more of the transfer functions being changed to change from operating in the first mode of operation to operating in the second mode of operation.

2. The method according to claim 1, wherein operating parameters of the second mode of operation are determined based on the received input indicative of the state of vehicle.

3. The method according to claim 1, wherein at least one parameter of the noise cancelling signal is modified based on the mode of operation.

4. The method according to claim 1, wherein the second mode of operation comprises outputting the noise cancelling signal with reduced volume, or not outputting the noise cancelling signal.

5. The method according to claim 1, wherein operating in the second mode of operation comprises modifying the one or more of the transfer functions.

6. The method according to claim 1, wherein the received input is further indicative of at least one of a group consisting of: a speed of the vehicle, and cabin noise.

7. A controller for a vehicle noise cancelling system, the controller comprising:

an electronic input to receive an input from a vehicle condition sensing means, wherein the received input indicates a position of at least one aperture closure member of the vehicle; and processing means to:

operate in a first mode of operation to output a noise cancelling signal to multiple noise cancelling zones within the vehicle;

determine if a noise cancelling error condition is present based on the input received from the vehicle condition sensing means; and operate in a second mode of operation based on the determination that the noise cancelling error condition is present based on the received input that indicates the position of the at least one aperture closure member;

wherein the noise cancelling signal is derived by applying transfer functions corresponding to different noise cancelling zones to a received audio signal, one or more of the transfer functions being changed to change from operating in the first mode of operation to operating in the second mode of operation.

8. The controller according to claim 7 comprising output means to output the noise cancelling signal based on the mode of operation.

9. The controller according to claim 7, configured to change the mode of operation from the first mode to the second mode by modifying at least one parameter of the noise cancelling signal.

10. The controller according to claim 7, configured to operate in the second mode by modifying the noise cancelling signal of the first mode or not outputting the noise cancelling signal.

11. The controller according to claim 7, wherein the controller is configured to modify the one or more of the transfer functions based on the mode of operation.

12. The controller according to claim 7, configured to change to the first mode if the noise cancelling error condition is determined as not present while operating in the second mode.

13. A noise cancelling system for a vehicle, the system comprising:

at least one vehicle condition sensing means to sense at least one vehicle condition; and a controller comprising:

an electronic input to receive an input from the at least one vehicle condition sensing means, wherein the received input indicates a position of at least one aperture closure member of the vehicle; and processing means to:

operate in a first mode of operation to output a noise cancelling signal to multiple noise cancelling zones within the vehicle;

determine if a noise cancelling error condition is present based on the input received from the vehicle condition sensing means; and operate in a second mode of operation based on the determination that the noise cancelling error condition is present based on the received input that indicates the position of the at least one aperture closure member;

wherein the noise cancelling signal is derived by applying transfer functions corresponding to different noise cancelling zones to a received audio signal, one or more of the transfer functions being changed to change from operating in the first mode of operation to operating in the second mode of operation.

14. The noise cancelling system according to claim 13, the system comprising:

a sound sensing means for detecting sound and outputting an audio signal; and an audio output means to output the noise cancelling signal.

15. The noise cancelling system according to claim 13, wherein the vehicle sensing means comprises: a sensor to determine aperture closure member position; and/or a sensor to determine a speed of the vehicle; and/or a sensor to determine noise in a cabin of the vehicle.

16. A non-transitory computer-readable medium storing instructions that, when executed by a processor, cause the processor to perform the method according to claim 1.

17. A vehicle comprising the controller according to claim 7.

* * * * *